US011840791B2

(12) United States Patent
Lee et al.

(10) Patent No.: US 11,840,791 B2
(45) Date of Patent: Dec. 12, 2023

(54) WASHING METHOD

(71) Applicant: LG ELECTRONICS INC., Seoul (KR)

(72) Inventors: Sunho Lee, Seoul (KR); Bonkwon Koo, Seoul (KR); Sunku Kwon, Seoul (KR); Sanghyun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 120 days.

(21) Appl. No.: 15/120,243

(22) PCT Filed: Feb. 17, 2015

(86) PCT No.: PCT/KR2015/001642
§ 371 (c)(1),
(2) Date: Aug. 19, 2016

(87) PCT Pub. No.: WO2015/126166
PCT Pub. Date: Aug. 27, 2015

(65) Prior Publication Data

US 2017/0058447 A1 Mar. 2, 2017

(30) Foreign Application Priority Data

Feb. 19, 2014 (KR) ..... 10-2014-0019231

(51) Int. Cl.
*D06F 35/00* (2006.01)
*D06F 37/38* (2006.01)
*D06F 37/24* (2006.01)

(52) U.S. Cl.
CPC ..... *D06F 35/006* (2013.01); *D06F 37/38* (2013.01); *D06F 37/24* (2013.01)

(58) Field of Classification Search
CPC ..... D06F 37/304; D06F 37/306; D06F 37/30–40; D06F 35/005–006
See application file for complete search history.

(56) References Cited

U.S. PATENT DOCUMENTS 4,556,827 A * 12/1985 Erdman ..... H02P 6/085 318/400.22
6,241,782 B1 * 6/2001 Vande Haar ..... D06F 35/006 8/159

(Continued)

FOREIGN PATENT DOCUMENTS

CN 102767065 11/2012
CN 103321013 9/2013

(Continued)

OTHER PUBLICATIONS

KR20040102505A Machine Translation (Year: 2004).*
European Search Report dated Aug. 31, 2017 issued in Application No. 15752374.7.
Chinese Office Action dated Jan. 17, 2018 issued in Application No. 201580020473.0 (with English translation).

(Continued)

*Primary Examiner* — Spencer E. Bell
(74) *Attorney, Agent, or Firm* — KED & ASSOCIATES, LLP

(57) ABSTRACT

A washing method according to the present invention comprises: a first rotation step for rotating an inner tub; a rotating direction detecting step for detecting the rotating direction of the inner tub; and a second rotation step for starting to rotate the inner tub in the opposite direction to the rotating direction of the inner tub when the rotation of the inner tub stops in the first rotation step. When the inner tub stops over a predetermined time and then restarts, the inner tub starts to rotate in the opposite direction to the rotating direction when the inner tub stops, thereby reducing the eccentricity of the inside of the inner tub, inhibiting collisions between the inner tub and an outer tub, reducing noise during collisions, and improving the rotation performance of the inner tub.

4 Claims, 7 Drawing Sheets

(56) References Cited

U.S. PATENT DOCUMENTS

| | | | | |
|---|---|---|---|---|
| 2001/0027579 | A1* | 10/2001 | Kwon | D06F 35/006 8/158 |
| 2003/0177794 | A1* | 9/2003 | Yoon | D06F 37/40 68/12.01 |
| 2003/0208855 | A1 | 11/2003 | McAllister et al. | |
| 2005/0217036 | A1* | 10/2005 | Park | D06F 35/006 8/158 |
| 2010/0307201 | A1* | 12/2010 | Shiga | D06F 37/304 68/140 |
| 2011/0179584 | A1* | 7/2011 | Kim | D06F 23/04 8/137 |
| 2013/0247307 | A1 | 9/2013 | Park et al. | |
| 2016/0040344 | A1* | 2/2016 | Li | D06F 37/264 8/137 |
| 2016/0201246 | A1* | 7/2016 | Song | D06F 37/40 8/137 |
| 2016/0244905 | A1* | 8/2016 | Lv | D06F 37/40 |
| 2016/0376741 | A1* | 12/2016 | Kim | D06F 37/206 310/90 |

FOREIGN PATENT DOCUMENTS

| | | | | |
|---|---|---|---|---|
| CN | 103459700 | | 12/2013 | |
| EP | 1 555 338 | | 7/2005 | |
| EP | 2 692 929 | | 2/2014 | |
| KR | 10-0155978 | | 12/1998 | |
| KR | 10-2004-0046081 | | 6/2004 | |
| KR | 10-2004-0102506 | | 12/2004 | |
| KR | 2004102505 | A * | 12/2004 | D06F 33/02 |
| KR | 10-2006-0120939 | | 11/2006 | |
| KR | 10-2011-0086447 | | 7/2011 | |
| KR | 10-2012-0124769 | | 11/2012 | |
| WO | WO 2011/025339 | | 3/2011 | |
| WO | WO 2012/128567 | | 9/2012 | |
| WO | WO 2012/134141 | | 10/2012 | |

OTHER PUBLICATIONS

Korean Office Action dated Apr. 13, 2020 issued by KR Application No. 10-2014-0019231.

* cited by examiner

WASHING METHOD

CROSS-REFERENCE TO RELATED PATENT APPLICATIONS

This application is a U.S. National Stage Application under 35 U.S.C. § 371 of PCT Application No. PCT/KR2015/001642, filed Feb. 17, 2015, which claims priority to Korean Patent Application No. 10-2014-0019231, filed Feb. 19, 2014, whose entire disclosures are hereby incorporated by reference.

TECHNICAL FIELD

The present invention relates to a washing method.

BACKGROUND ART

In general, a washing machine is an appliance that treats clothing or bedding (hereinafter, referred to as "laundry") using physical action and/or chemical action. A washing machine includes an outer tub, in which wash water is held, and an inner tub, in which laundry is contained and which is rotatably mounted in the outer tub.

A typical washing method of the washing machine includes a process of physically washing laundry by rotating the inner tub and a process of dehydrating laundry using the centrifugal force of the inner tub.

Specifically, the rotation of the inner tub is stopped for a certain time period when required between respective washing processes or in a certain washing process, and the inner tub resumes rotation in a predetermined direction in a subsequent process, irrespective of the rotating direction before the stoppage in the previous process, which causes eccentricity of the laundry.

Eccentricity of the laundry becomes a cause of collisions between the inner tub and the outer tub, and consequently there occurs a problem in that collisions between the inner tub and the outer tub generate noise and deteriorate the efficiency of the washing machine.

DISCLOSURE

Technical Problem

An object of the present invention is to prevent the eccentricity of the laundry contained in an inner tub during the respective washing processes.

The object to be accomplished by the present invention is not limited to the above-mentioned object, and other objects not mentioned will be clearly understood by those skilled in the art from the following description.

Technical solution

In accordance with an aspect of the present invention, the above and other objects can be accomplished by the provision of a washing method including primarily rotating an inner tub, detecting a rotating direction of the inner tub, and secondarily rotating the inner tub in a direction opposite the rotating direction of the inner tub when the primarily rotating the inner tub is completed.

The secondarily rotating may be performed after lapse of a predetermined time period after completion of the primarily rotating.

The primarily rotating may include rotating the inner tub in one direction.

Alternatively, the primarily rotating may include rotating the inner tub alternately in one and reverse directions.

The secondarily rotating may include rotating the inner tub in one direction.

Alternatively, the secondarily rotating may include rotating the inner tub alternately in both directions.

The inner tub may be rotated at a higher rotating speed in the secondarily rotating than in the primarily rotating.

Alternatively, the inner tub may be rotated at a lower rotating speed in the secondarily rotating than in the primarily rotating.

The embodiment may further include supplying wash water to the inner tub before the primarily rotating.

The embodiment may further include discharging the wash water from the inner tub before the secondarily rotating.

The primarily rotating may include rotating a pulsator in the same rotating direction as the rotating direction of the inner tub.

The secondarily rotating may include rotating a pulsator in the same rotating direction as the rotating direction of the inner tub.

The primarily rotating may include gradually increasing a rotating speed of the inner tub.

The secondarily rotating may include gradually increasing a rotating speed of the inner tub.

The secondarily rotating may include continuously rotating the inner tub in one direction so that wash water in an outer tub rises along a space between the outer tub and the inner tub due to centrifugal force and falls into the inner tub.

Details of other embodiments of the present invention are included in the detailed description and the accompanying drawings.

Advantageous Effects

The embodiment is configured such that, when an inner tub is re-operated after stopping over a predetermined time period, the inner tub is rotated in the direction opposite the rotating direction before stopping, thereby providing effects in that eccentricity in the inner tub is eliminated, collisions between the inner tub and the outer tub are prevented, noise attributable to collisions is reduced, and the rotating performance of the inner tub is improved.

Accordingly, a washing method of the embodiment may eliminate the eccentricity of the laundry in the inner tub between respective processes and may also eliminate the eccentricity of the laundry during each process.

The effects of the invention are not limited to the above-mentioned effects, and other effects not mentioned will be clearly understood by those skilled in the art from the appended claims.

BEST MODE FOR IMPLEMENTING THE INVENTION

Figure 1:
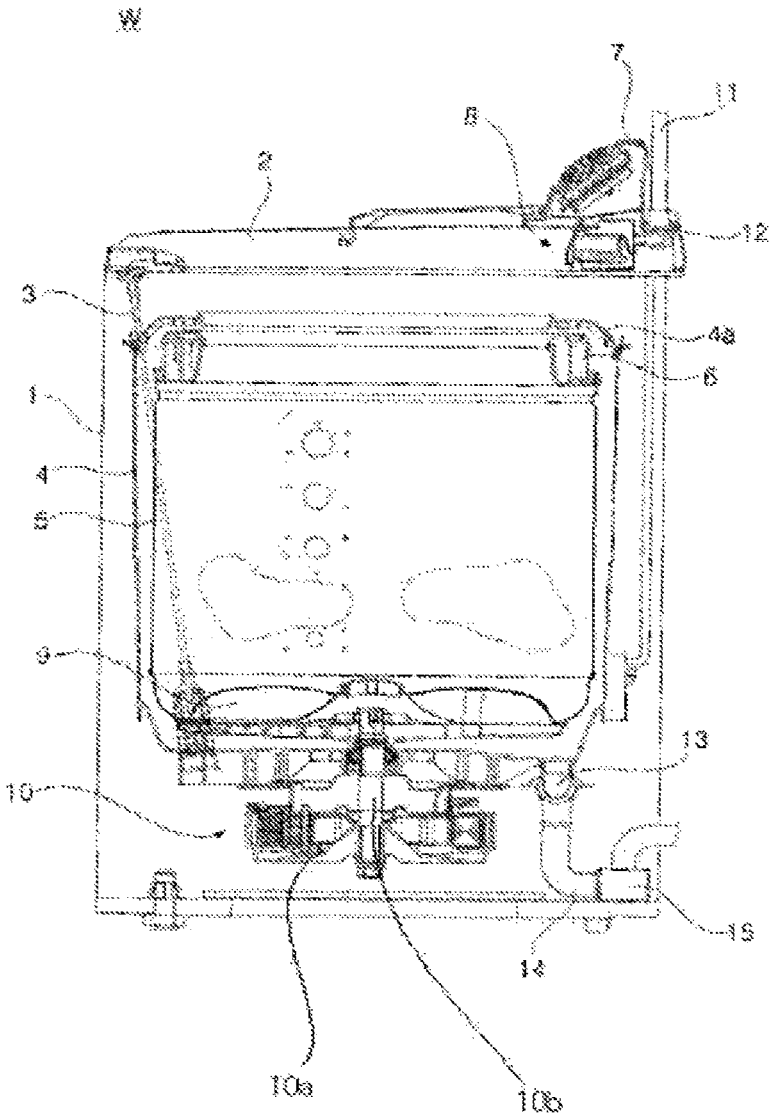
FIG. 1 is a longitudinal sectional view of a washing machine according to a first embodiment of the present invention.

The above and other aspects, features, and advantages of the invention will become apparent from the detailed description of the following embodiments in conjunction with the accompanying drawings. It should be understood that the present invention is not limited to the following embodiments and may be embodied in different ways, and that the embodiments are provided for complete disclosure and thorough understanding of the invention to those skilled in the art. The scope of the invention is defined only by the claims. Like components will be denoted by like reference numerals throughout the specification.

Hereinafter, embodiments of the present invention will be described with reference to the drawings for explaining a washing machine.

Figure 2:
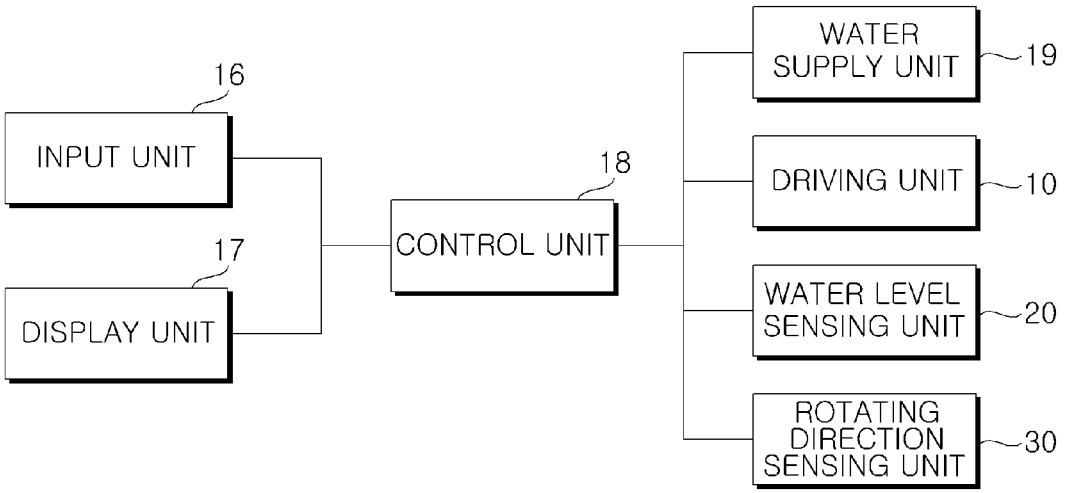
FIG. 2 is a view illustrating a control relationship among main units of the washing machine depicted in FIG. 1.

FIG. 1 is a longitudinal sectional view of a washing machine according to an embodiment of the present invention, and FIG. 2 is a view illustrating a control relationship among main units of the washing machine depicted in FIG. 1.

Referring to FIGS. 1 and 2, a washing machine W according to an embodiment of the present invention comprises a cabinet 1 having an open top portion, a top cover 2 for covering the open top portion of the cabinet and having a laundry loading hole formed in a substantially central portion thereof, through which laundry is loaded, a control panel 7 provided in the top cover, an outer tub 4 suspended in the cabinet by a suspension 3, an inner tub 5 rotatably disposed in the outer tub 4 and configured to contain the laundry therein, a pulsator 9 rotatably disposed on the bottom of the inner tub, a driving unit 10 for supplying driving force required for rotation of the inner tub and/or the pulsator, a water supply unit 19 for supplying water between the outer tub and the inner tub, a drain valve 13, a drain passage 14 and a drain pump 15 for discharging water from the outer tub, an input unit 16 provided in the control panel in order to allow a user to input a variety of control commands, a display unit 17 for displaying the operational state of the washing machine W, and a water level sensing unit 20 for detecting the water level in the outer tub.

The outer tub 4 may be disposed in the cabinet 1. Wash water used to wash the laundry may be contained in the outer tub 4. The outer tub 4 may have an opening formed in the top thereof, through which the laundry is loaded and unloaded.

The outer tub 4 may be mounted in the cabinet 1 in a shock-absorbing manner by means of a damper or a hanger.

The laundry may be contained in the inner tub 5. The inner tub 5 may be disposed in the cabinet 1, and may be formed to be smaller than the outer tub 4 so as to be disposed in the outer tub 4. The outer tub 4 may function as a tub in which wash water is contained, and the inner tub 5 may function as a tub in which the laundry is washed by the wash water.

The top portion of the inner tub 5 may be open so that the laundry can be loaded and unloaded therethrough.

The pulsator 9 may be rotatably disposed on the bottom of the inner tub 5. The pulsator 9 is connected to the driving unit 10.

The driving unit 10 for rotating the pulsator 9 and/or the inner tub 5 may be mounted to the outer tub 4.

For example, the driving unit 10 may include a motor 10*a* for generating driving force, and a rotating shaft 10*b* for transmitting the rotational force from the motor 10*a* to the inner tub 5 and/or the pulsator 9.

It is possible for the driving unit 10 to rotate the pulsator 9 or the inner tub 5. It is also possible for the driving unit 10 to rotate the pulsator 9 and the inner tub 5.

The rotational force generated from the motor 10*a* is transmitted via the rotating shaft 10*b*, thereby rotating the inner tub 5 and/or the pulsator 9. At this time, in order to selectively rotate the inner tub 5 and/or the pulsator 9, there may be provided a clutch (not illustrated) for achieving engagement between the rotating shaft 10*b* and the inner tub 5 or between the rotating shaft 10*b* and the pulsator 9, and furthermore, in order to control the rotation of the motor 10*a* by applying a driving signal to the motor 10*a* under the control of the control unit 18, there may be provided a driving driver (not illustrated).

The rotating shaft 10*b* of the motor 10*a* may be preferably arranged parallel to the direction of gravity.

The driving driver applies a driving signal having a predetermined pattern to the motor 10*a* so that the motor 10*a* is rotated based on the driving signal.

The driving signal may have a variety of patterns, which include an ON time period, during which electric current is applied to the motor 10*a*, and an OFF time period, during which electric current is not applied to the motor 10*a*.

In particular, the driving driver may be implemented by a driving circuit of a power device such as a power MOSFET (Metal-Oxide-Semiconductor Field-Effect Transistor) for controlling power or an IGBT (Insulated Gate Bipolar Transistor), which is commonly referred to as an IPM (Intelligent Power Module), or by a power module provided with a self-protection function.

On the other hand, according to the control of the control unit 18 with respect to the operation of the clutch, any one of the inner tub 5 and the pulsator 9 may be selectively rotated, or the inner tub 5 and the pulsator 9 may be rotated at the same time. Various types of clutches may be applied to typical washing machines, and although not illustrated in the embodiment, the clutch may be variously implemented by those skilled in the art.

The control unit 18 controls a variety of components including the input unit 16, the display unit 17, the water supply unit 19, the driving unit 10, the water level sensing unit 20 and the rotating direction sensing unit 30.

In order to allow water to flow between the inner tub 5 and the outer tub 4, the inner tub is formed with a plurality of through-holes, and a balancer 6 is provided on the top portion of the inner tub in order to compensate for eccentricity attributable to the position of the laundry.

An outer tub cover 4*a* is provided on the top portion of the outer tub 4 in order to guide the water, which rises along the space between the outer tub and the inner tub due to centrifugal force while the inner tub 5 is rotating, to fall into the inner tub.

The water supply unit 19 may include a water supply passage 11, through which the water supplied from an external water source such as a water tap flows, a water supply valve 12 for opening and closing the water supply passage, and a detergent containing unit 8, which is disposed in the water supply passage to contain detergent.

If the water supply valve 12 is opened by the control unit 18, the water, which flows through the water supply passage 11, is supplied between the outer tub 4 and the inner tub 5 with the detergent via the detergent containing unit 8. The control unit 18 may open and close the water supply valve 12 multiple times according to a predetermined washing algorithm, and when the water is supplied after all the detergent has been washed out of the detergent containing unit 8 by the water, the detergent is not, of course, supplied to the outer tub 4 anymore.

The control unit 18 opens and closes the water supply valve 12 based on the sensing signal from the water level sensing unit 20 so as to adjust the water in the outer tub 4 to reach a predetermined level.

The rotating direction sensing unit 30 detects the direction in which the inner tub 5 and/or the pulsator 9 is rotated, and outputs a sensing signal to the control unit 18.

The rotating direction sensing unit 30 may indirectly detect the rotating direction of the inner tub 5 and/or the pulsator 9 by detecting the rotating direction of the motor 10*a*. Alternatively, the rotating direction sensing unit 30 may directly detect the rotating direction of the inner tub 5.

For example, the rotating direction sensing unit 30 includes a hall sensor (not illustrated) and a switch in order to detect the rotating direction of the motor 10*a*. In particular, the rotating direction sensing unit 30 includes at least two hall sensors, which detect pulses having a 90-degree phase difference therebetween depending on the rotation of the motor 10*a* in the forward direction (CW) or in the reverse direction (CCW), thereby detecting the rotating direction of the motor 10*a*.

Although not illustrated in the embodiment of the present invention, the hall sensor and the switch may be variously implemented by those skilled in the art.

The control unit 18 controls the driving unit 10 based on the sensing signal from the rotating direction sensing unit 30.

Further, the control unit 18 may include a storage device such as a memory (not illustrated) for storing sensing results from the respective sensing units and information input through the input unit 16 by a user.

Figure 3:
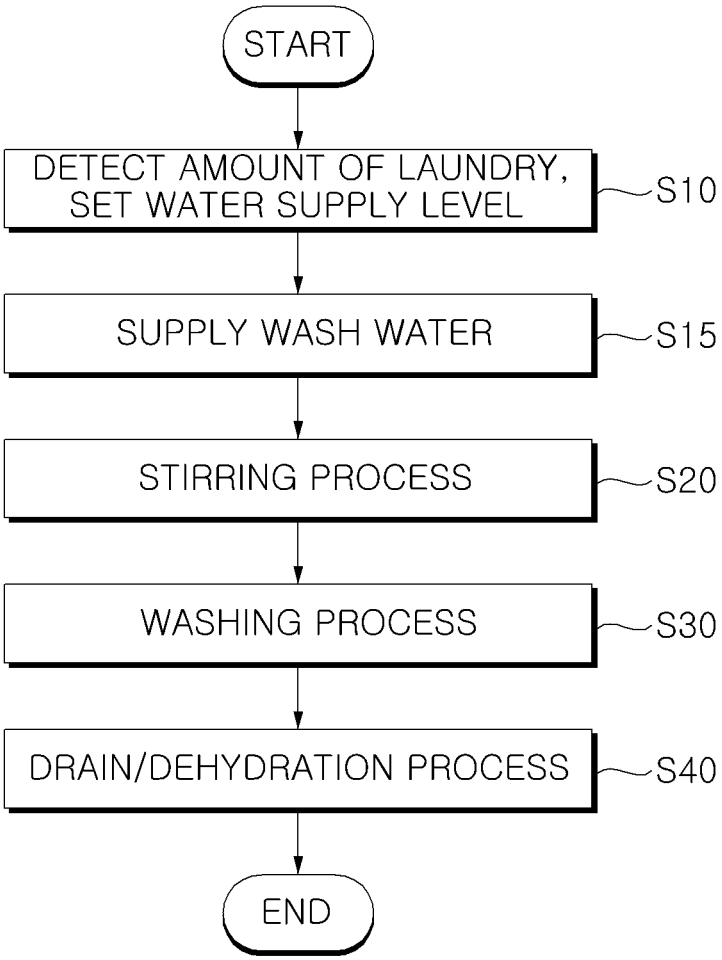
FIG. 3 is a view illustrating a general washing method.

FIG. 3 is a view illustrating a general washing method.

Referring to FIG. 3, a general washing method includes a first step, in which the amount of laundry is detected, and a water supply level is determined based on the amount of laundry (S10).

Here, in the state in which the laundry is loaded in the inner tub 5, the amount of laundry is detected while the pulsator 9 stirs the laundry, and the wash water level is determined so as to be in proportion to the amount of laundry.

In detail, the control unit 18 detects the amount of laundry based on the number of pulses generated by the inertial force acting on the motor 10*a* when the motor 10*a* is turned off during the rotation of the pulsator 9 in the forward/reverse directions by the driving unit 10.

Once the water supply level has been determined, the wash water is supplied corresponding to the determined water supply level (S15).

In detail, the control unit 18 stops the motor 10*a* after detecting the amount of laundry, opens the water supply valve 12 so that the wash water and the detergent are supplied together to the inner tub 5 and the outer tub 4 through the water supply unit 19, and closes the water supply valve 12 when the water level sensing unit 20, which is mounted to a portion of the outer tub 4 in order to detect the water level in the inner tub 5 and the outer tub 4, senses that the wash water has reached a minimum level.

At this time, the minimum level is a value that is set to be lower than the wash water level, which is determined based on the amount of laundry, and varies depending on the amount of laundry so that the laundry is not completely immersed in the wash water.

In more detail, the water supply unit 19 supplies the water, which is supplied from an external water source, to the space between the outer tub 4 and the inner tub 5 via the detergent containing unit 8, so that the supplied water rises from the bottom of the outer tub 4, and upon determining that the water in the outer tub 4 has reached a predetermined target level Al based on the sensing result from the water level sensing unit 20, the control unit 18 performs control for stopping the water supply.

Subsequently, the control unit 18 controls the pulsator 9 or the inner tub 5 to be rotated alternately in both directions in order to evenly dissolve the detergent in the wash water (S20, hereinafter referred to as a stirring process). This process is not necessarily performed after the water supply (S15) is completed, and may also be performed while the water supply (S15) is being performed.

Subsequently, the inner tub 5 or the pulsator 9 is rotated in one direction or in both directions in order to wash the laundry (S30) (hereinafter, referred to as a washing process).

In detail, the control unit 18 may continuously rotate the outer tub in one direction so that the wash water in the outer tub 4 rises along the space between the outer tub 4 and the inner tub 5 due to centrifugal force and then falls into the inner tub 5. At this time, the pulsator 9 may be rotated together with the inner tub 5.

Specifically, when the pulsator 9 is rotated together with the inner tub 5, the pulsator 9 may be rotated in the same direction as the rotating direction of the inner tub 5 so as to maximize the centrifugal force acting on the wash water, or may be rotated in the direction opposite the rotating direction of the inner tub 5 so as to maximize the frictional force between the laundry and the pulsator 9.

Subsequently, the wash water is discharged, and moisture is removed from the wet laundry by applying centrifugal force to the wet laundry (S40).

In detail, the control unit 18 intermittently rotates the inner tub 5 at a low speed in order to decrease the eccentricity of the wet laundry, and subsequently rotates the inner tub 5 in one direction at a high speed.

The above-described general washing method includes a step in which the rotation of the pulsator 9 and/or the inner tub 5 is stopped for a predetermined time period between the respective processes or in a certain process.

When the pulsator 9 and/or the inner tub 5 resumes rotation after having been stopped, the control unit 18 controls the pulsator 9 and/or the inner tub 5 to rotate in a predetermined initial rotating direction irrespective of the rotating direction before the stoppage.

Therefore, while the pulsator 9 and/or the inner tub 5 is stopped over a predetermined time period, the laundry in the inner tub 5 is biased to one side of the inner tub by inertial force. Subsequently, when the pulsator 9 and/or the inner tub 5 resumes rotation in the same direction as the rotating direction before the stoppage, the outer tub 4 vibrates and noise is generated due to the eccentricity of the laundry. Further, the unbalanced laundry may reduce the life span of the inner tub 5.

Therefore, when the pulsator 9 and/or the inner tub 5 resumes rotation after stoppage over a predetermined time period, the pulsator 9 and/or the inner tub 5 needs to rotate in the direction opposite the rotating direction before the stoppage in order to reduce the noise from the inner tub 5

(generated by contact between the outer tub 4 and the inner tub 5) and improve the rotating performance of the inner tub 5.

Hereinafter, a method of preventing the eccentricity of the laundry in the inner tub 5 and reducing the noise from the inner tub 5 will be explained in detail.

Figure 4:
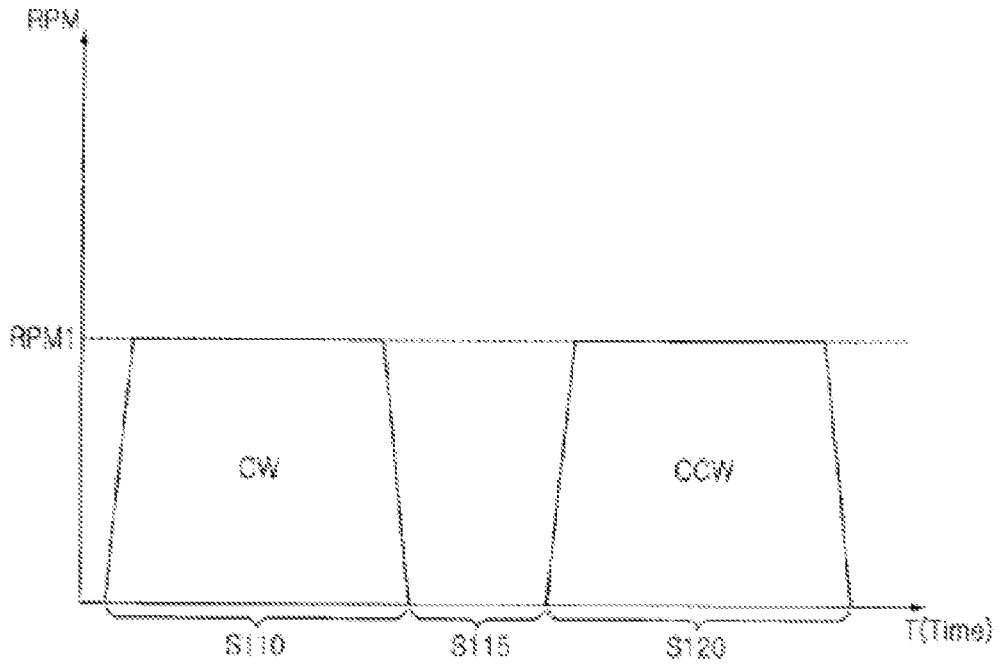
FIGS. 4 and 5 are views illustrating a washing method according to one embodiment of the present invention.
Figure 5:
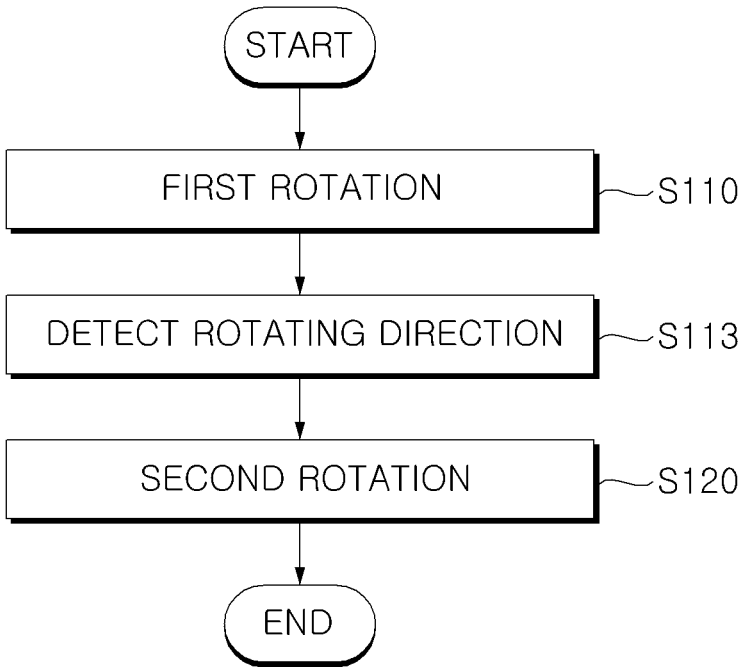

FIGS. 4 and 5 are views illustrating a washing method according to one embodiment of the present invention.

FIG. 4 is a graph showing variation in the rotating speed of the inner tub as time elapses, and FIG. 5 is a flowchart showing the washing method of the embodiment.

Referring to FIGS. 4 and 5, the washing method of the embodiment includes a first rotation step (S110) for rotating the inner tub 5, a rotating direction detecting step (S113) for detecting the rotating direction of the inner tub 5, and a second rotation step (S120) for starting to rotate the inner tub 5 in the direction opposite the rotating direction of the inner tub 5 when the rotation of the inner tub 5 is stopped in the first rotation step (S110).

In the first rotation step (S110), the inner tub 5 is rotated.

In detail, in the first rotation step (S110), the control unit 18 controls the driving unit 10 to rotate the inner tub 5 at a predetermined rotating speed.

In the first rotation step (S110), the inner tub 5 may be continuously rotated in one direction at a predetermined speed (RPM1). As illustrated in FIG. 4, the inner tub 5 may be continuously rotated clockwise (CW) (rotation in the forward direction). However, the inner tub 5 may be intermittently rotated in some embodiments.

Alternatively, in the first rotation step (S110), the inner tub 5 may be rotated alternately in both directions. This will be described later.

In the first rotation step (S110), wash water may or may not be present in the inner tub 5. That is, in the first rotation step (S110), when no wash water is present in the inner tub 5, this step may belong to the dehydration process, and when wash water is present in the inner tub 5, this step may belong to the stirring process or to the washing process.

Preferably, the embodiment may further include a wash water supply step for supplying the wash water to the inner tub 5 before the first rotation step (S110). The embodiment may further include a wash water discharge step for discharging the wash water supplied to the inner tub 5 before the second rotation step (S120).

Of course, in order to increase the centrifugal force acting on the wash water, the pulsator 9 may be rotated in the same rotating direction as the rotating direction of the inner tub 5 in the first rotation step (S110).

In the rotating direction detecting step (S113), the rotating direction of the inner tub 5 is detected.

For example, the rotating direction sensing unit 30 detects the rotating direction of the inner tub 5 and outputs the detection signal to the control unit 18. In detail, the rotating direction sensing unit 30 detects the rotating direction of the motor 10*a* and outputs the detection signal to the control unit 18, and the control unit 18 determines the rotating direction of the inner tub 5 based on the signal that the control unit 18 receives from the rotating direction sensing unit 30.

Further, the rotating direction sensing unit 30 detects the rotating direction of the motor 10*a* and outputs the detection signal to the control unit 18, and the control unit 18 determines the rotating direction of the pulsator 9 based on the signal that the control unit 18 receives from the rotating direction sensing unit 30.

In the second rotation step (S120), the inner tub 5 starts to be rotated in the direction opposite the rotating direction of the inner tub 5 when the rotation of the inner tub 5 is completed in the first rotation step (S110).

Here, it is preferable that the second rotation step (S120) be performed after the rotation of the inner tub 5 in the first rotation step (S110) is stopped and the movement of the laundry in the inner tub 5 due to inertial force (generated by the rotation of the inner tub 5) is stopped.

In detail, the second rotation step (S120) may be performed after the lapse of a predetermined time period (for example, 2 seconds or more) after the completion of the first rotation step (S110).

Of course, the control unit 18 may perform a step (S115) for controlling the driving unit 10 to forcibly stop the inner tub 5.

In detail, in the second rotation step (S120), the control unit 18 determines the rotating direction of the inner tub 5 in the first rotation step (S110) based on the detection signal from the rotating direction sensing unit 30, and controls the driving unit 10 so that the inner tub 5 starts to be rotated in the direction opposite the rotating direction of the inner tub 5 in the first rotation step (S110).

For example, if the inner tub 5 is rotated clockwise (CW) and stops in the first rotation step (S110), the inner tub 5 may start to be rotated counterclockwise (CCW) in the second rotation step (S120). Of course, the opposite case may also be possible.

In the second rotation step (S120), the control unit 18 controls the driving unit 10 to rotate the inner tub 5 at a predetermined rotating speed.

In the second rotation step (S120), the inner tub 5 may be rotated in one direction at a predetermined speed (RPM 1). As illustrated in FIG. 4, the inner tub 5 may be continuously rotated counterclockwise (CCW). Of course, the rotating speed of the inner tub 5 in the second rotation step (S120) may be the same as or different from the rotating speed of the inner tub 5 in the first rotation step (S110).

Further, the inner tub 5 may be rotated alternately in both directions in the second rotation step (S120). This will be described later.

In the second rotation step (S120), wash water may or may not be present in the inner tub 5. That is, in the second rotation step (S120), when no wash water is present in the inner tub 5, this step may belong to the dehydration process, and when wash water is present in the inner tub 5, this step may belong to the stirring process or to the washing process.

Of course, in order to increase the centrifugal force acting on the wash water, the pulsator 9 may be rotated in the same rotating direction as the rotating direction of the inner tub 5 in the second rotation step (S120).

As described above, in the second rotation step (S120), if the inner tub 5 starts to be rotated in the direction opposite the rotating direction of the inner tub 5 when the first rotation step (S110) is finished, there is an advantage in that the eccentricity of the laundry is easily eliminated and collisions between the inner tub 5 and the outer tub are prevented, which may be caused when the rotating direction of the inner tub 5 is not changed when a subsequent pattern is performed after completion of a certain washing pattern.

The first rotation step (S110) and the second rotation step (S120) may belong to the same washing process (pattern) or may belong to different washing processes (patterns).

For example, both the first rotation step (S110) and the second rotation step (S120) may belong to the stirring process, the washing process or the dehydration process.

In another example, the first rotation step (S110) may belong to the stirring process, and the second rotation step (S120) may belong to the washing process. Alternatively, the first rotation step (S110) may belong to the washing process, and the second rotation step (S120) may belong to the dehydration process.

In still another example, the first rotation step (S110) and the second rotation step (S120) may belong to the dehydration process, at which time the rotating speed of the inner tub 5 in the first rotation step (S110) and/or the second rotation step (S120) may be gradually increased, thereby eliminating the eccentricity of the laundry.

Accordingly, the washing method of the embodiment may eliminate the eccentricity of the laundry in the inner tub 5 between the respective processes and may also eliminate the eccentricity of the laundry during each process.

Referring again to FIG. 4, the washing method of the embodiment may include a first rotation step (S110) for rotating the inner tub 5, a stopping step (S115) for stopping the inner tub 5 for a predetermined time period, and a second rotation step (S120) for rotating the inner tub 5, and in the second rotation step (S120), the inner tub 5 may start to be rotated in the direction opposite the rotating direction of the inner tub 5 in the first rotation step (S110).

The steps except for the stopping step are the same as explained above.

In the stopping step (S115), the inner tub 5 is stopped for a predetermined time period.

Here, the predetermined time period may be enough time for the inner tub 5, which is rotated in the first rotation step (S110), to stop rotation and for the laundry in the inner tub 5 to stop movement due to inertial force (generated by the rotation of the inner tub 5).

The control unit 18 controls the driving unit 10 to stop the inner tub 5.

Figure 6:
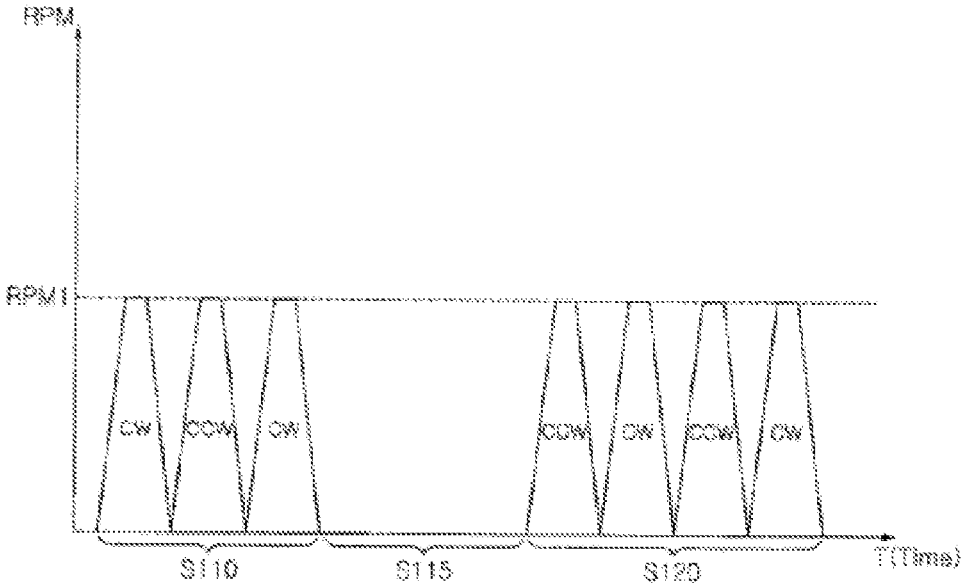
FIGS. 6 and 7 are views illustrating a washing method according to another embodiment of the present invention.
Figure 7:
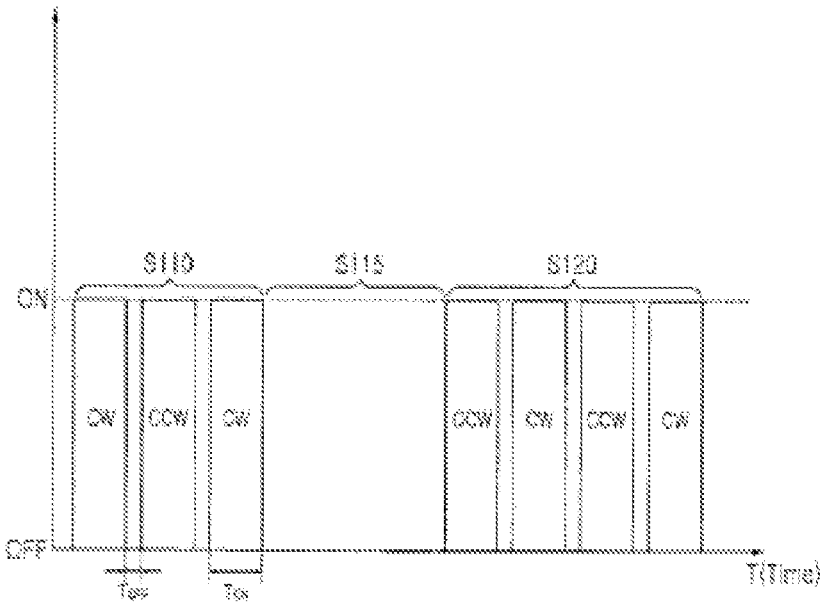

FIGS. 6 and 7 are views illustrating a washing method according to another embodiment of the present invention.

Referring to FIGS. 6 and 7, the washing method of the embodiment differs from the embodiment in FIG. 4 with respect to the rotation of the inner tub 5 in the first rotation step (S110) and the rotation of the inner tub 5 in the second rotation step (S120).

Hereinafter, a duplicated description of configuration that is the same as in the embodiment in FIGS. 4 and 5 will be omitted.

In the first rotation step (S110), the inner tub 5 may be rotated alternately in both directions.

In detail, in the first rotation step (S110), the inner tub 5 may be rotated alternately clockwise (CW) and counterclockwise (CCW). The time period during which the inner tub 5 stops to change the rotating direction of the inner tub 5 in the first rotation step (S110) may be much shorter than the time period during which the inner tub 5 stops between the first rotation step (S110) and the second rotation step (S120). That is, when the rotating direction of the inner tub 5 is changed in the first rotation step (S110), the inner tub 5 stops for a moment, but the laundry is rotated by inertia.

In the second rotation step (S120), the inner tub 5 starts to be rotated in the direction opposite the rotating direction of the inner tub 5 when the rotation of the inner tub 5 is completed in the first rotation step (S110).

For example, if the inner tub 5 is rotated clockwise (CW) and stops in the first rotation step (S110), the inner tub 5 may start to be rotated counterclockwise (CCW) in the second rotation step (S120). Of course, the opposite case may also be possible.

In the second rotation step (S120), the control unit 18 controls the driving unit 10 to rotate the inner tub 5 at a predetermined rotating speed.

The inner tub may be rotated alternately in both directions in the second rotation step (S120).

In detail, in the second rotation step (S120), the inner tub 5 may be rotated alternately clockwise (CW) and counterclockwise (CCW). The time period during which the inner tub 5 stops to change the rotating direction of the inner tub 5 in the second rotation step (S120) may be much shorter than the time period during which the inner tub 5 stops between the first rotation step (S110) and the second rotation step (S120). That is, when the rotating direction of the inner tub 5 is changed in the second rotation step (S120), the inner tub 5 stops for a moment, but the laundry is rotated by inertia.

In more detail, in the second rotation step (S120), the control unit 18 may control the rotating direction of the inner tub 5 by reversing the polarity of the driving voltage of the motor 10*a* of the driving unit 10.

Of course, in the first rotation step (S110) and the second rotation step (S120), the control unit 18 may turn the motor 10*a* of the driving unit 10 on/off, thereby preventing the motor 10*a* from heating up.

Figure 8:
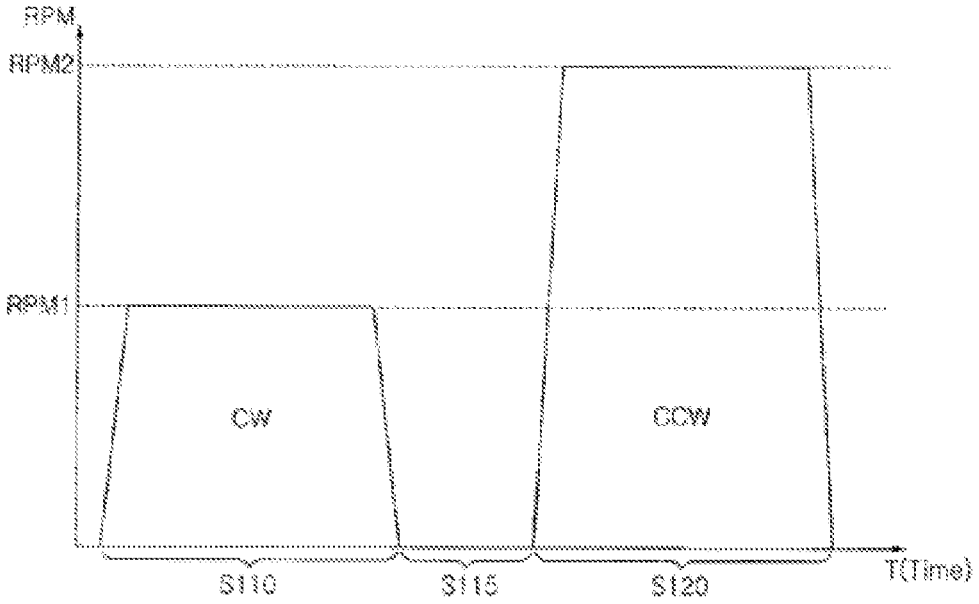
FIG. 8 is a view illustrating a washing method according to still another embodiment of the present invention.

FIG. 8 is a view illustrating a washing method according to still another embodiment of the present invention.

Referring to FIG. 8, the washing method of the embodiment differs from the embodiment in FIG. 4 with respect to the rotating speed of the inner tub 5 in the first rotation step (S110) and the rotating speed of the inner tub 5 in the second rotation step (S120).

In detail, in the embodiment, the rotating speed (RPM2) of the inner tub 5 in the second rotation step (S120) may be higher than the rotating speed (RPM1) of the inner tub 5 in the first rotation step (S110). Here, the rotating speed (RPM1) in the first rotation step (S110) and the rotating speed (RPM2) in the second rotation step (S120) may be set to be suitable for the respective processes.

Alternatively, although not illustrated in the drawings, the rotating speed (RPM2) of the inner tub 5 in the second rotation step (S120) may be lower than the rotating speed (RPM1) of the inner tub 5 in the first rotation step (S110).

In more detail, the control unit 18 may change the rotating speed of the motor 10*a* by controlling the voltage supplied to the driving unit 10, and the variation in the rotating speed of the motor 10*a* may change the rotating speed of the inner tub 5.

For example, the first rotation step (S110) may correspond to a low-speed rotation period for eliminating the eccentricity of the laundry in the dehydration process, and the second rotation step (S120) may correspond to a high-speed rotation period for removing moisture from the laundry using centrifugal force in the dehydration process.

In another example, the first rotation step (S110) may belong to the stirring process for stirring the laundry, and the second rotation step (S120) may belong to the centrifugal circulation washing process.

Here, the centrifugal circulation washing process is a process for continuously rotating the inner tub 5 in one direction so that the wash water in the outer tub 4 rises along the space between the outer tub and the inner tub 5 due to centrifugal force and then falls into the inner tub 5.

Therefore, even though there is a difference in the rotating speed of the inner tub 5 between the respective processes, the embodiment may eliminate the eccentricity of the laundry and may prevent collisions between the inner tub 5 and the outer tub.

Figure 9:
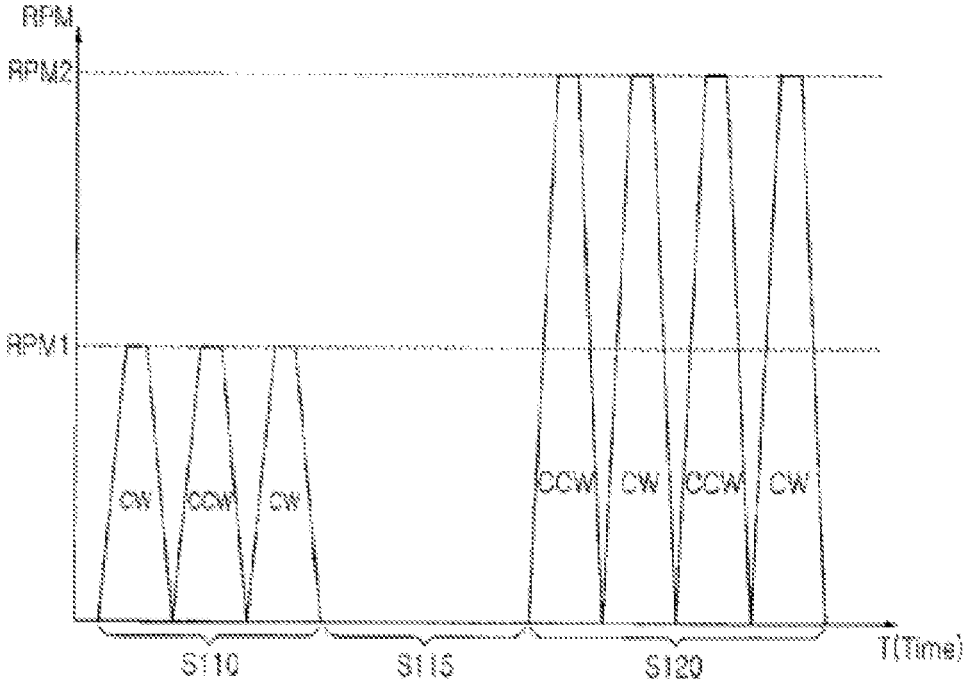
FIG. 9 is a view illustrating a washing method according to yet another embodiment of the present invention.

FIG. 9 is a view illustrating a washing method according to yet another embodiment of the present invention.

Referring to FIG. 9, the washing method of the embodiment differs from the embodiment in FIG. 8 with respect to the rotation of the inner tub 5 in the first rotation step (S110) and the rotation of the inner tub 5 in the second rotation step (S120).

In detail, in the embodiment, the rotating speed (RPM2) of the inner tub 5 in the second rotation step (S120) may be higher than the rotating speed (RPM1) of the inner tub 5 in the first rotation step (S110). Here, the rotating speed (RPM1) in the first rotation step (S110) and the rotating speed (RPM2) in the second rotation step (S120) may be set to be suitable for the respective processes.

In more detail, the control unit 18 may change the rotating speed of the motor 10*a* by controlling the voltage supplied to the driving unit 10, and the variation in the rotating speed of the motor 10*a* may change the rotating speed of the inner tub 5.

The inner tub 5 may be rotated alternately in both directions in the first rotation step (S110).

In detail, in the first rotation step (S110), the inner tub 5 may be rotated alternately clockwise (CW) and counterclockwise (CCW). The time period during which the inner tub 5 stops to change the rotating direction of the inner tub 5 in the first rotation step (S110) may be much shorter than the time period during which the inner tub 5 stops between the first rotation step (S110) and the second rotation step (S120). That is, when the rotating direction of the inner tub 5 is changed in the first rotation step (S110), the inner tub 5 stops for a moment, but the laundry is rotated by inertia.

In more detail, in the first rotation step (S110), the control unit 18 may control the rotating direction of the inner tub 5 by reversing the polarity of the driving voltage of the motor 10*a* of the driving unit 10.

The inner tub may be rotated alternately in both directions in the second rotation step (S120).

In detail, in the second rotation step (S120), the inner tub 5 may be rotated alternately clockwise (CW) and counterclockwise (CCW). The time period during which the inner tub 5 stops to change the rotating direction of the inner tub 5 in the second rotation step (S120) may be much shorter than the time period during which the inner tub 5 stops between the first rotation step (S110) and the second rotation step (S120). That is, when the rotating direction of the inner tub 5 is changed in the second rotation step (S120), the inner tub 5 stops for a moment, but the laundry is rotated by inertia.

In more detail, in the second rotation step (S120), the control unit 18 may control the rotating direction of the inner tub 5 by reversing the polarity of the driving voltage of the motor 10*a* of the driving unit 10.

Of course, in the first rotation step (S110) and the second rotation step (S120), the control unit 18 may turn the motor 10*a* of the driving unit 10 on/off, thereby preventing the motor 10*a* from heating up.

Figure 10:
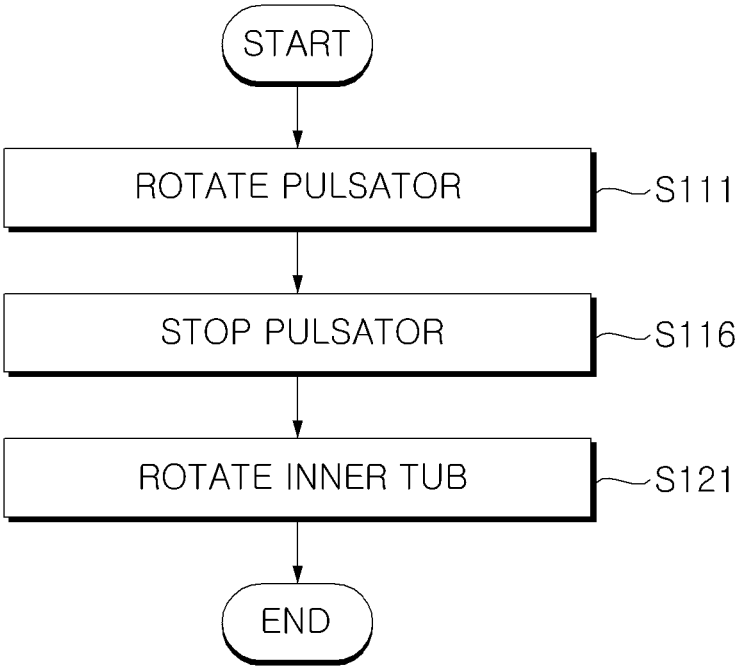
FIG. 10 is a view illustrating a washing method according to still yet another embodiment of the present invention.

FIG. 10 is a view illustrating a washing method according to still yet another embodiment of the present invention.

The washing method of the embodiment includes a pulsator rotation step (S111) for rotating the pulsator 9, a stopping step (S116) for stopping the pulsator 9 for a predetermined time period, and an inner tub rotation step (S121) for rotating the inner tub 5.

In the pulsator rotation step (S111), the pulsator 9 is rotated.

In detail, in the pulsator rotation step (S111), the control unit 18 controls the driving unit 10 to rotate the pulsator 9 at a predetermined rotating speed.

In the pulsator rotation step (S111), the pulsator 9 may be rotated in one direction at a predetermined speed (RPM1). For example, the pulsator 9 may be rotated clockwise (CW).

Alternatively, in the pulsator rotation step (S111), the pulsator 9 may be rotated in one direction, or may be rotated alternately in both directions.

In the stopping step (S116), the pulsator 9 is stopped for a predetermined time period.

Here, the predetermined time period may be enough time for the pulsator 9 to stop rotation and for the laundry in the inner tub 5 to stop movement due to inertial force (generated by the rotation of the inner tub 5).

The control unit 18 controls the driving unit 10 to stop the pulsator 9.

In the inner tub rotation step (S121), the inner tub 5 starts to be rotated in the direction opposite the rotating direction of the pulsator 9 in the pulsator rotation step (S111).

In detail, in the inner tub rotation step (S121), the inner tub 5 starts to be rotated in the direction opposite the rotating direction of the pulsator 9 when the rotation of the pulsator 9 is completed in the pulsator rotation step (S111).

Here, it is preferable that the inner tub rotation step (S121) be performed after the rotation of the pulsator 9 in the pulsator rotation step (S111) is stopped and the movement of the laundry in the inner tub 5 due to inertial force (generated by the rotation of the inner tub 5) is stopped. In detail, the inner tub rotation step (S121) may be performed after the lapse of a predetermined time period (for example, 2 seconds or more) after completion of the pulsator rotation step (S111).

In detail, in the inner tub rotation step (S121), the control unit 18 determines the rotating direction of the pulsator 9 in the pulsator rotation step (S111) based on the detection signal from the rotating direction sensing unit 30, and controls the driving unit 10 so that the inner tub 5 starts to be rotated in the direction opposite the rotating direction of the pulsator 9 in the pulsator rotation step (S111).

In more detail, the control unit 18 may control the rotating direction of the inner tub 5 by reversing the polarity of the driving voltage of the motor 10*a* of the driving unit 10.

For example, if the pulsator 9 is rotated clockwise (CW) and stops in the pulsator rotation step (S111), the inner tub 5 may start to be rotated counterclockwise (CCW) in the inner tub rotation step (S121). Of course, the opposite case may also be possible.

In the inner tub rotation step (S121), the control unit 18 controls the driving unit 10 to rotate the inner tub 5 at a predetermined rotating speed.

In the inner tub rotation step (S121), the inner tub 5 may be rotated in one direction at a predetermined speed (RPM 1). Of course, the rotating speed of the inner tub 5 in the inner tub rotation step (S121) may be the same as or different from the rotating speed of the inner tub 5 in the pulsator rotation step (S111).

Further, the inner tub 5 may be rotated alternately in both directions in the inner tub rotation step (S121).

Although preferred embodiments of the present invention have been described for illustrative purposes, those skilled in the art will appreciate that various modifications, additions and substitutions are possible, without departing from the scope and the spirit of the invention as disclosed in the accompanying claims.

The invention claimed is:

1. A washing method of a washing machine including an inner tub configured to hold washing items and a pulsator rotatably provided within the inner tub, the washing method comprising:

supplying wash water to the inner tub;

performing a washing process of the washing items using the wash water, the performing of the washing process including:

primarily rotating the inner tub alternately clockwise and counterclockwise;

detecting a rotating direction of the inner tub when primarily rotating the inner tub;

stopping the rotating of the inner tub for a predetermined time period after primarily rotating the inner tub, the washing items stopping movement due to inertial force during the predetermined time period; and secondarily rotating the inner tub alternately clockwise and counterclockwise when the predetermined time period lapses, the inner tub initially rotating when secondarily rotating the inner tub in a direction opposite to the rotating direction of the inner tub that is last detected before the predetermined time period; and discharging the wash water and spinning the washing items after performing the washing process, wherein a temporary time period during which the inner tub stops to change the rotating direction while primarily rotating the inner tub is shorter than the predetermined time period, wherein the inner tub is rotated at a higher rotating speed when secondarily rotating than when primarily rotating, wherein primarily rotating the inner tub includes rotating the pulsator in the rotating direction of the inner tub, wherein secondarily rotating the inner tub includes rotating the pulsator in a same rotating direction as the inner tub, wherein the pulsator is configured to rotate independently of the inner tub when primarily rotating the inner tub, wherein the pulsator is configured to rotate independently from the inner tub when secondarily rotating the inner tub, wherein a rotation speed of the pulsator is different from a rotation speed of the inner tub when primarily rotating the inner tub and secondarily rotating the inner tub, and wherein the predetermined time period during which the rotating of the inner tub is stopped between primarily rotating the inner tub and secondarily rotating the inner tub is at least two seconds so that the washing items in the inner tub stop rotating.

2. The washing method according to claim 1, wherein primarily rotating the inner tub includes gradually increasing the rotating speed of the inner tub.

3. The washing method according to claim 2, wherein secondarily rotating the inner tub includes gradually increasing the rotating speed of the inner tub.

4. The washing method of claim 3, wherein the pulsator stops rotating during the predetermined time period.

* * * * *